US005776650A

United States Patent [19]

Hashimoto et al.

[11] Patent Number: 5,776,650

[45] Date of Patent: Jul. 7, 1998

[54] METHOD OF MANUFACTURING ORGANIC PHOTOCONDUCTOR FOR ELECTROPHOTOGRAPHY

[75] Inventors: Kei Hashimoto; Nobuyoshi Mori, both of Nagano, Japan

[73] Assignee: Fuji Electric Co., Ltd., Kawasaki, Japan

[21] Appl. No.: 621,585

[22] Filed: Mar. 26, 1996

[30] Foreign Application Priority Data

Mar. 29, 1995 [JP] Japan ..... 7-071123

[51] Int. Cl.[6] ..... G03G 5/06

[52] U.S. Cl. ..... 430/134; 430/135

[58] Field of Search ..... 430/134, 135

[56] References Cited

U.S. PATENT DOCUMENTS

| | | | |
|---|---|---|---|
| 4,209,327 | 6/1980 | Ohta et al. | 430/82 |
| 4,264,694 | 4/1981 | Pu et al. | 430/58 |
| 4,615,965 | 10/1986 | Matsumoto et al. | 430/134 |
| 4,980,254 | 12/1990 | Hiro | 430/135 |
| 5,324,615 | 6/1994 | Stegbauer et al. | 430/134 |
| 5,545,499 | 8/1996 | Balthis et al. | 430/96 |

FOREIGN PATENT DOCUMENTS 6043672 2/1994 Japan .

*Primary Examiner*—Roland Martin
*Attorney, Agent, or Firm*—Morrison Law Firm

[57] ABSTRACT

A charge generation layer and a method of manufacturing a charge generation layer of a highly sensitive organic photoconductor for electrophotography is provided, wherein the charge generation layer is formed by using a dispersion liquid in which an organic pigment or dye is so dispersed as to be fully utilized as a charge generation agent. The organic pigment or dye is dispersed and pulverized in a dispersing solvent, with ball-shaped pulverizing media of about 0.1 to about 0.3 mm in diameter, to an average particle size of from about 0.1 to about 0.3 μm. The ratio of the organic pigment or dye to the solid components of the dispersion liquid is set at about 5 to about 95 weight %. The ball-shaped pulverizing media are removed from the dispersion liquid prior to dip coat formation of the charge generation layer. The total weight of the ball-shaped pulverizing media is set at about 0.25 to about 5 times as heavy as the weight of the dispersion liquid.

3 Claims, 1 Drawing Sheet

METHOD OF MANUFACTURING ORGANIC PHOTOCONDUCTOR FOR ELECTROPHOTOGRAPHY

BACKGROUND OF THE INVENTION

The present invention relates to a method of manufacturing an organic photoconductor for electrophotography, and more specifically the present invention relates to a method of preparing a dispersion liquid of an organic pigment or dye used in manufacturing the photoconductor for electrophotography.

Inorganic photoconductive materials such as selenium, selenium alloys, zinc sulfide, or cadmium sulfide have been mainly used for the material of the photoconductors. However, the conventional inorganic photoconductors are not always satisfactory with respect to such factors as sensitivity, resistivity against printing environments, or toxicity.

Recently, various photoconductors which use organic photoconductive materials have been reported, and some of them have been already put into practical use. The organic photoconductors have been attracting much attention, since they are lighter in weight, more transparent, more flexible, and manufactured more easily than the inorganic photoconductors.

For example, Japanese Examined Patent Publication No. S50-10496 discloses a photoconductor which contains poly-N-vinylcarbazole and 2,4,7-trinitro-9-fluorenone. Japanese Examined Patent Publication No. S48-25658 discloses a photoconductor which contains poly-N-vinylcarbazole sensitized with a pyrylium pigment. However, these photoconductors exhibit insufficient sensitivity and durability.

Other so-called function-separation-type photoconductors which have a charge generation layer and a charge transport layer have been proposed. For example, the Japanese Examined Patent Publication No. S55-42380 discloses a function-separation-type photoconductor which combines chlorodian blue and a hydrazone compound.

By dividing the functions of the photoconductor to different layers, i.e., the charge generation layer and charge transport layer, photoconductors exhibiting various characteristics may be obtained easily. Based on this expectation, various combinations of a charge generation and charge transport layer have been proposed so far for obtaining photoconductors which exhibit excellent sensitivity and durability.

The function-separation-type photoconductors, which have a charge generation layer and a charge transport layer, are presently usually manufactured by dip coating in order to facilitate mass-productivity. The properties of the charge generation layer are directly influential on the improvement of the sensitivity of the photoconductor. For example, massive charge generation in the charge generation layer during light exposure, uniform charge generation in a plane of the charge generation layer, and highly efficient injection of generated charges into the charge transport layer are positively effective to improve the sensitivity of the photoconductor.

The properties of the photoconductor which includes the charge generation layer formed by dip coating depend greatly on the organic pigment contained in the charge generation layer, and the crystal form and particle size of the organic pigment. The particle size of the organic pigment is determined by the method and conditions of dispersing the pigment in the dip coating liquid for the charge generation layer.

The liquid which contains pigment dispersoids is prepared, as well known to those skilled in the art, by dispersing a pigment and binder, at least for more than an hour and in the longest case for several tens of hours, with a means such as, for example, a vibrating mill, planetary mill, paint shaker, three roll mill, ball mill, attrition mill, or sand grinder.

From the view points of photoconductive properties and mass-productivity, the two factors of how long and how stably the pigment remains dispersed without coagulation are important for the prepared dip coating liquid.

If an organic pigment remains stably dispersed over a long elapse of time, the time span between the replacements of the dispersion liquid may be prolonged. Therefore, the longer time-dependent dispersion stability of the organic pigment is more preferable for improving mass-productivity of the photoconductor which includes a photoconductive layer formed by dipping a conductive substrate in the dispersion liquid.

However, it is quite difficult to establish the time-dependent dispersion stability of the organic pigment. Dispersion of the organic pigment sometimes becomes unstable quite quickly depending on the dispersing conditions. Thus, unsolved problems remain in improving the mass-productivity of the organic photoconductors.

The particle size of the organic pigment dispersoid tends to increase by coagulation, depending on the dispersing conditions. Since deterioration of the photoconductive properties is closely related with overly large particle size, it becomes harder to obtain the desired photoconductive properties as the particle size increases. When the pigment is dispersed excessively to decrease the particle size too much, the particle size will then increases too quickly on the scale of an hour to deteriorate the time-dependent dispersion stability of the organic pigment.

OBJECTS AND SUMMARY OF THE INVENTION

In view of the foregoing, it is an object of the present invention to provide a method of manufacturing an organic photoconductor for electrophotography which improves the mass-productivity and stability of the photoconductor by stabilizing time-dependent dispersion of the charge generation material in the coating liquid for forming the charge generation layer.

It is an object of the present invention to provide an organic pigment or organic dye dispersion liquid for forming the charge generation layer of the photoconductor in which the pigment or dye dispersoids are prevented from coagulating for a time period long enough to cause no problems in practical use of the dispersion liquid.

It is an object of the present invention to provide pigment or dye dispersoids for organic photoconductors for electrophotography through a step of dispersing an organic pigment or an organic dye together with a resin binder, with ball-shaped pulverizing media, in a dispersing solvent to an average particle size of from 0.1 to 0.3 μm.

It is an object of the present invention to provide a dispersion liquid for organic photoconductors for electrophotography which exhibits excellent dispersion stability of the pigment or dye dispersoids, and facilitates manufacturing electro-photographic photoconductors having a charge generation layer which exhibits excellent photoconductive properties.

It is an object of the present invention to provide pigment or dye dispersoids through a step in which, by using the ball-shaped pulverizing media of from 0.1 to 0.3 mm in diameter and from 0.25 to 5 times as heavy as the weight of the dispersion liquid, the contact areas between the pigment and pulverizing media are increased.

It is an object of the present invention to provide pigment or dye dispersoids through a step in which, by increasing the weight ratio of the pulverizing media, the pulverizing capability is increased.

It is an object of the present invention to provide a method to pulverize pigment or dye dispersoids for organic photoconductors for electrophotography so efficiently as to reduce the average particle size of the pigment dispersoids in a short time, and to narrow the distribution of the pigment particle size.

Briefly stated, a charge generation layer and a method of manufacturing a charge generation layer of a highly sensitive organic photoconductor for electrophotography is provided, wherein the charge generation layer is formed by using a dispersion liquid in which an organic pigment or dye is so dispersed as to be fully utilized as a charge generation agent, and a method is provided of manufacturing such highly sensitive organic photoconductor for electrophotography. The organic pigment or dye is dispersed and pulverized in a dispersing solvent, with ball-shaped pulverizing media of about 0.1 to about 0.3 mm in diameter, to an average particle size of from about 0.1 to about 0.3 μm. The ratio of the organic pigment or dye to the solid components of the dispersion liquid is set at about 5 to about 95 weight %. The ball-shaped pulverizing media are removed from the dispersion liquid prior to dip coat formation of the charge generation layer. The total weight of the ball-shaped pulverizing media is set at about 0.25 to about 5 times as heavy as the weight of the dispersion liquid.

The present invention provides a method of manufacturing a charge generation layer of an organic photoconductor for electrophotography, the method comprising dispersing and pulverizing, with ball-shaped pulverizing media, an organic pigment or an organic dye and a resin binder in a dispersing solvent to an average particle size of from about 0.1 to about 0.3 μm, to form a dispersion liquid, and forming the charge generation layer by coating a surface with the dispersion liquid.

The present invention provides a charge generation layer of an organic photoconductor for electrophotography comprising the charge generation layer being formed by a first step of dispersing and pulverizing, with ball-shaped pulverizing media, an organic pigment or an organic dye and a resin binder in a dispersing solvent to an average particle size of from about 0.1 to about 0.3 μm, to form a dispersion liquid, and a second step of forming the charge generation layer by coating a surface with the dispersion liquid.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
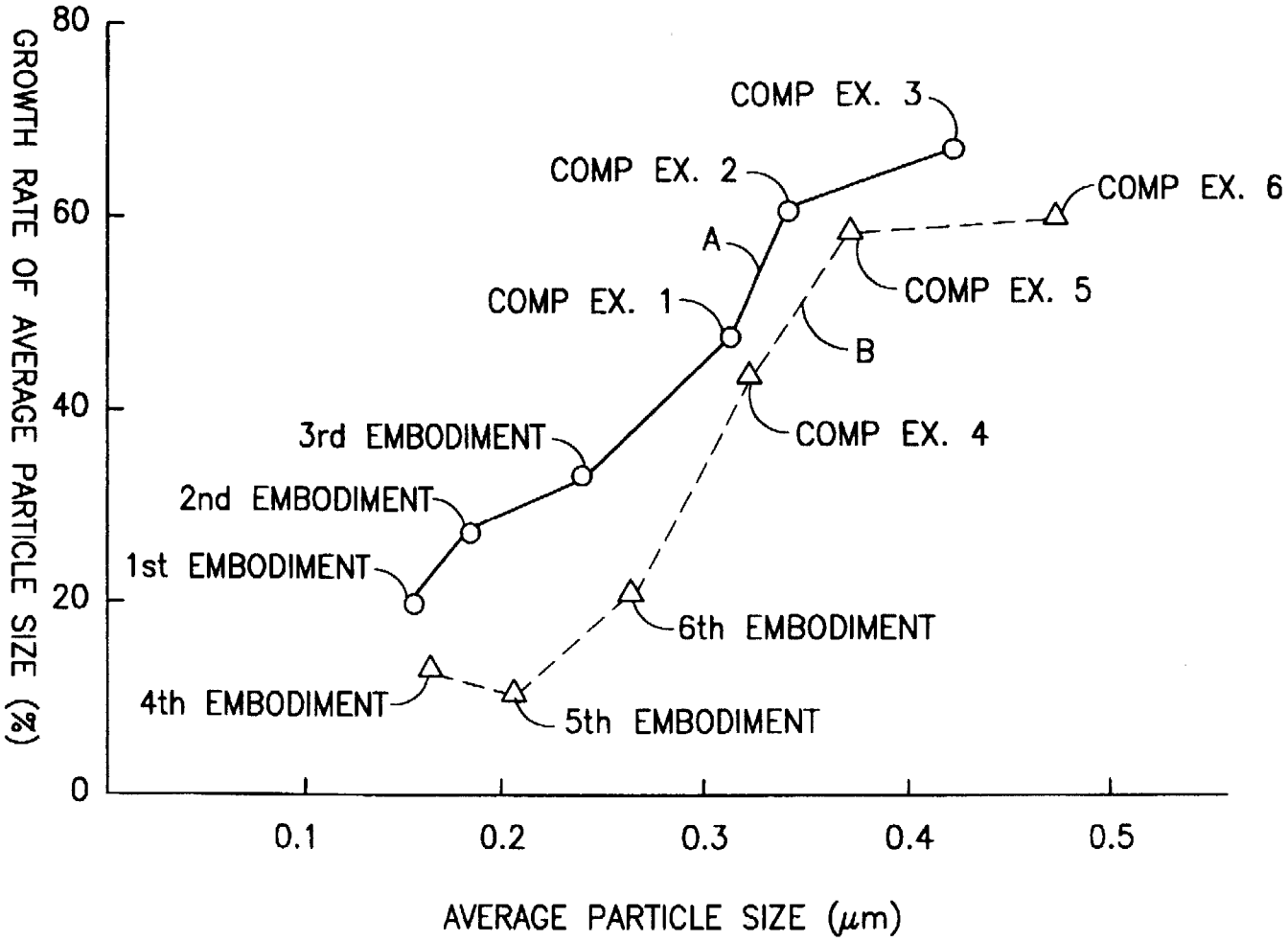
FIG. 1 is a plot of two curves relating the 5 days' growth of the average particle sizes of the pigment dispersoids to the initial average particle sizes.

According to the present invention, there is provided a method of manufacturing an organic photoconductor for electrophotography including a charge generation layer, the method comprising: a step of dispersing and pulverizing, with ball-shaped pulverizing media, an organic pigment or an organic dye and a resin binder to an average particle size of from 0.1 to 0.3 μm in a dispersing solvent to prepare a dispersion liquid; and a step of forming the charge generation layer by dip coating using the dispersion liquid.

Advantageously, the ratio of the organic pigment or the organic dye to the solid components of the dispersion liquid is from 5 to 95 weight %.

Advantageously, the ball-shaped pulverizing media are from 0.1 to 0.3 mm in diameter. It is preferable to remove the ball-shaped pulverizing media from the dispersion liquid prior to the step of forming.

Advantageously, the total weight of the ball-shaped pulverizing media used in the step of dispersing and pulverizing is from 0.25 to 5 times as heavy as the weight of the dispersion liquid.

By preparing the organic pigment or organic dye dispersion liquid for forming the charge generation layer of the photoconductor through a step of dispersing an organic pigment or an organic dye together with a resin binder, with ball-shaped pulverizing media, in a dispersing solvent to an average particle size of from 0.1 to 0.3 μm, the pigment or dye dispersoids are prevented from coagulating for a time period long enough to cause no problems in practical use of the dispersion liquid.

The dispersion liquid of the invention, which exhibits excellent dispersion stability of the pigment or dye dispersoids, facilitates manufacturing electro-photographic photoconductors having a charge generation layer which exhibits excellent photoconductive properties.

By using the ball-shaped pulverizing media of from 0.1 to 0.3 mm in diameter and from 0.25 to 5 times as heavy as the weight of the dispersion liquid, the contact areas between the pigment and pulverizing media are increased. By increasing the weight ratio of the pulverizing media, the pulverizing capability is increased. By these measures, the pigment is pulverized so efficiently as to reduce the average particle size of the pigment dispersoids in a short time, and to narrow the distribution of the pigment particle size. Furthermore, the charge generation efficiency per pigment content may be improved.

Organic pigments or dyes which are dispersed into a dispersing agent according to the present invention are not specifically limited as far as the pigments or the dyes may function as a charge generating agent in the charge generation layer. For example, pigments such as phthalocyanine pigments, perylene pigments, bis-azo pigments, polycyclic quinone pigments or indigo pigments, and dyes such as squaraine dyes or azulenium dyes are used.

For example, tetrahydrofuran, dioxane, benzene, toluene, xylene, acetone, methyl ethyl ketone, methyl isobutyl ketone, cyclohexanone, dimethylformamide, methanol, ethanol, propanol, etc. are used as a solvent (dispersing agent). In dispersing an organic pigment, a binder may be added which includes a poly(vinyl butyral) resin, polyacrylate resin, polyester resin, epoxy resin, styrene resin, polycarbonate resin, urethane resin, and acrylic resin.

Dispersing treatment is conducted for several hours in any convenient dispersing apparatus, such as, for example, the previously mentioned vibrating mill, paint shaker, or sand grinder. the dispersing treatment is performed with ball-shaped pulverizing media, which are from 0.1 to 0.3 mm in diameter, made of, e.g., glass, stainless steel, zirconia, or ceramics, and not changed physically and chemically by the solvent or the pigment. The weight of the ball-shaped pulverizing media is set appropriately between a quarter to five times as heavy as the dispersion liquid. Any dispersion liquid which contains pigment dispersoids may be used as far as the final ratio of the solid components is from 1 to 10 weight %, and the final ratio of the pigment to the solid components is from 5 to 95 weight %. The average particle size of the pigment dispersoids is preferably from 0.1 to 0.3 μm, and more preferably from 0.1 to 0.25 μm.

Coating methods for coating the pigment dispersion liquid include, for example, dip coating, seal coating, ring coating, spray coating, and wire bar coating. It is preferable to dry the coated liquid at room temperature or by heating at most up to about 200° C.

The charge generation layer is formed to the thickness of less than 10 μm and more preferably from 0.1 to 1 μm.

The photoconductor manufactured by the method of the invention is a function-separation-type one which comprises a charge generation layer, containing a charge generation agent and laminated on a conductive substrate, and a charge transport layer, containing a charge transport agent and laminated on the charge generation layer.

If necessary, an undercoating layer, which exhibits a barrier and adhesive function, may be disposed between the charge generation and transport layers.

Metal substrates or plastic substrates provided with electric conductivity may be used as the conductive substrate of the present photoconductor. The conductive substrates may be sheet-like, belt-like or cylindrical.

For example, aluminum, aluminum alloys, copper, etc. may be used as the substrate material. Metal or plastic substrates, coated with an aluminum layer, aluminum alloy layer, copper layer, or a tin oxide layer deposited by vacuum deposition, may be used. Metal or plastic substrates on which an undercoating layer containing an electrically conductive agent and a binder resin is laminated, or a plastic substrate containing an electrically conductive agent may also be used.

The undercoating layer may be formed with poly(vinyl alcohol), poly(vinyl methyl ether), polyamide, polyurethane, melamine resin, phenol resin, aluminum oxide, etc. The undercoating layer is formed to the thickness of from 0.05 to 20 μm, and more preferably from 0.05 to 10 μm.

The charge transport layer contains a binder resin and a charge transport agent for which the known charge transport materials may be used. For example, compounds such as hydrazone, hydrazine, triarylamine, styrylamine, indole, indoline, butadiene, or pyrazole, or their derivatives may be used for the charge transport agent. Furthermore, a poly (vinyl butyral) resin, styrene resin, polycarbonate resin, polyester resin, epoxy resin, urethane resin, and acrylic resin may be used as the binder resin.

The charge transport layer is formed to the thickness of from 10 to 50 μm, and more preferably from 15 to 40 μm.

Various additives may be added, if necessary, to the photoconductor of the invention for ease of film formation, and for improving the photoconductive properties such as resistivity against exposure light, mechanical strength, potential stability, or other photoconductive properties.

Though the present invention will be explained in detail hereinafter with reference to the preferred embodiments thereof, it will be apparent that changes and modifications may be made without departing from the true spirit of the invention.

First embodiment

An aluminum plate of 30 mm×30 mm×1 mm(t) was prepared for a conductive substrate. An undercoating liquid was prepared by dissolving 8 weight parts of a nylon copolymer resin (Daiamid T-171 supplied from Daicel Huls Ltd.) into a solvent mixture of 70 weight parts of methanol and 30 weight parts of n-butanol. Then, an undercoating layer was formed on the conductive substrate to the thickness of 0.5 μm by coating the substrate with the undercoating liquid, and drying the undercoating liquid at 90° C. for 20 min.

A bis-azo pigment, represented by the following structural formula (1), was used as a charge generation agent.

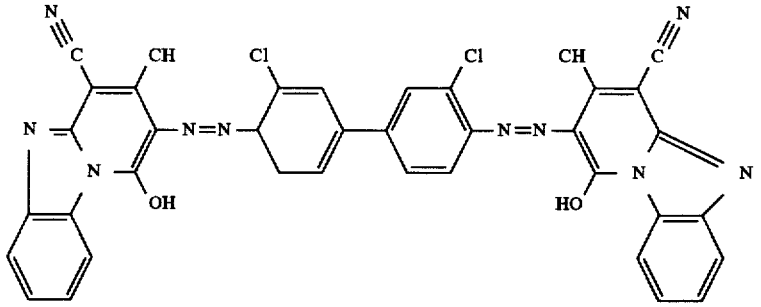

Formula (1)

A dispersion liquid was prepared by dispersing 10 weight parts of the above described bis-azo pigment, 10 weight parts of poly(vinyl butyral) resin (S.LEC BH-S supplied from Sekisui Chemical Co., Ltd.) and 100 weight parts of cyclohexanone (dispersing solvent) in a sand grinder with zirconia beads of 0.25 mm in diameter as the ball-shaped pulverizing media for 3 hrs. A coating liquid for charge generation layer formation was prepared by diluting the dispersion liquid with 500 weight parts of tetrahydrofuran. A charge generation layer was formed to the coating weight of 0.2 g/m$^2$ (to the thickness of 0.2 μm) by drying the coating liquid dip-coated on the undercoating layer at 90° C. for 20 min.

A hydrazone compound, represented by the following structural formula (2), was used as a charge transport agent.

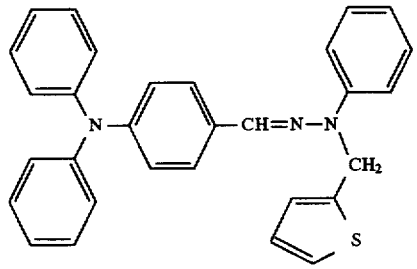

Formula (2)

A coating liquid for charge transport layer formation was prepared by dissolving 10 weight parts of the above described hydrazone compound, 10 weight parts of polycarbonate resin (Panlite TS-2050 supplied from TEIJIN LTD.), 0.5 weight parts of tri-o-tolylphosphine, and 0.1 weight parts of dibutylhydroxytoluene (BHT) as a hindered phenolic antioxidant into 90 weight parts of tetrahydrofuran. A charge transport layer was formed to the thickness of 20 μm by dip-coating the coating liquid on the charge generation layer, and drying the coating liquid at 100° C. for 20 min. Thus, a three-layered flat electrophotographic photoconductor was fabricated.

Second embodiment

The second embodiment of a photoconductor was fabricated in the same manner as the first embodiment except that zirconia beads of 0.2 mm in diameter were used in preparing a pigment dispersion liquid for charge generation layer formation.

Third embodiment

The third embodiment of a photoconductor was fabricated in the same manner as the first embodiment except that zirconia beads of 0.3 mm in diameter were used in preparing a pigment dispersion liquid for charge generation layer formation.

Comparative example 1

A comparative photoconductor was fabricated in the same manner as the first embodiment except that zirconia beads of 0.4 mm in diameter were used in preparing a pigment dispersion liquid for charge generation layer formation.

Comparative example 2

A comparative photoconductor was fabricated in the same manner as the first embodiment except that zirconia beads of 1.0 mm in diameter were used in preparing a pigment dispersion liquid for charge generation layer formation.

Comparative example 3

A comparative photoconductor was fabricated in the same manner as the first embodiment except that zirconia beads of 2.0 mm in diameter were used in preparing a pigment dispersion liquid for charge generation layer formation.

An average particle size of the pigment dispersoids in each dispersion liquid for fabricating each of the first through third embodiments and the comparative examples 1 through 3 was measured with a quasi-elastic light-scattering-type particle size distribution analyzer (BI-90 supplied from BROOKHEAVEN INSTRUMENTS Co. Ltd.), immediately after and 5 days after each dispersion liquid had been prepared, for obtaining an initial value and for investigating time-dependent stability of each pigment dispersion liquid.

Photoconductive properties were measured in the following manner with a static charge tester (EPA8100 supplied from Kawaguchi Denki Seisakusho). At first, an initial charge potential was measured by charging up each of the photoconductors to negative. Then, a half decay exposure light intensity E½, necessary for reducing the surface potential to half the initial potential, was measured by irradiating white light at an illuminance of 2 Lx. Results are listed in Table 1.

TABLE 1

| | Zirconia beads | Dispersing | Average particle size of organic pigment (μm) | | Half decay exposure light |
|---|---|---|---|---|---|
| | diameter (mm) | period (hr) | Initial | 5 days later | intensity (Lx, s) |
| 1st. Embodiment | 0.1 | 3 | 0.15 | 0.18 | 1.41 |
| 2nd. Embodiment | 0.2 | 3 | 0.18 | 0.23 | 1.50 |
| 3rd. Embodiment | 0.3 | 3 | 0.24 | 0.32 | 1.68 |
| Comparative 1 | 0.4 | 3 | 0.31 | 0.46 | 1.94 |
| Comparative 2 | 1.0 | 3 | 0.34 | 0.55 | 2.02 |
| Comparative 3 | 2.0 | 3 | 0.42 | 0.71 | 2.27 |

As can be seen from Table 1, a smaller average particle size and excellent dispersion stability are obtained by dispersing the pigment with the zirconia beads of 0.3 mm or less in diameter. As Table 1 indicates, photoconductors with excellent half decay exposure light intensity are obtained by using the pigment dispersion liquid prepared with the zirconia beads of 0.3 mm or less in diameter.

Fourth embodiment

The fourth embodiment of a photoconductor was fabricated in the same manner as the first embodiment except for X-type metal-free phthalocyanine used as a charge generation agent in place of the bis-azo pigment and glass beads of 0.1 mm in diameter used in place of the zirconia beads.

Fifth embodiment

The fifth embodiment of a photoconductor was fabricated in the same manner as the fourth embodiment except that glass beads of 0.2 mm in diameter were used.

Sixth embodiment

The sixth embodiment of a photoconductor was fabricated in the same manner as the fourth embodiment except that glass beads of 0.3 mm in diameter were used.

Comparative example 4

A comparative photoconductor was fabricated in the same manner as the fourth embodiment except that glass beads of 0.4 mm in diameter were used.

Comparative example 5

A comparative photoconductor was fabricated in the same manner as the fourth embodiment except that glass beads of 1.0 mm in diameter were used.

Comparative example 6

A comparative photoconductor was fabricated in the same manner as the fourth embodiment except that glass beads of 2.0 mm in diameter were used.

An average particle size of the pigment dispersoids in each dispersion liquid for fabricating each of the fourth through sixth embodiments and the comparative examples 4 through 6 was measured in the same manner as the first through third embodiments and the comparative examples 1 through 3.

Photoconductive properties of the fourth through sixth embodiments and the comparative examples 4 through 6 were measured in the same manner as the first through third embodiments and the comparative examples 1 through 3 except that a monochromatic ray of 780 nm was irradiated at the illuminance of 0.5 $\mu W/cm^2$. Results are listed in Table 2.

TABLE 2

| | Glass beads diameter (mm) | Dispersing period (hr) | Average particle size of organic pigment (μm) Initial | 5 days later | Half decay exposure light intensity (mJ/cm²) |
|---|---|---|---|---|---|
| 4th. Embodiment | 0.1 | 3 | 0.16 | 0.18 | 0.23 |
| 5th. Embodiment | 0.2 | 3 | 0.20 | 0.22 | 0.27 |
| 6th. Embodiment | 0.3 | 3 | 0.26 | 0.34 | 0.30 |
| Comparative 4 | 0.4 | 3 | 0.32 | 0.46 | 0.35 |
| Comparative 5 | 1.0 | 3 | 0.37 | 0.59 | 0.41 |
| Comparative 6 | 2.0 | 3 | 0.47 | 0.76 | 0.48 |

As can be seen from Table 2, a smaller average particle size and excellent dispersion stability are obtained by dispersing the pigment with the glass beads of less than 0.4 mm in diameter. And, as Table 2 indicates, photoconductors with excellent half decay exposure light intensity are obtained by using the pigment dispersion liquid prepared with the glass beads of less than 0.4 mm in diameter.

FIG. 1 displays two curves relating the 5 days' growth of the average particle sizes of the pigment dispersoids to the initial average particle sizes.

The solid curve in the figure is for the bis-azo pigment (corresponding to the first through third embodiments and the comparative examples 1 through 3). The broken curve in the figure is for the X-type metal-free phthalocyanine pigment (corresponding to the fourth through sixth embodiments and the comparative examples 4 through 5).

On both curves there are remarkable differences for the growth rates ((average particle size 5 days later/initial average particle size−1)×100%) of the average particle sizes between the embodiments where the initial particle sizes are less than 0.3 μm, and the comparative examples where the initial particle sizes are larger than 0.3 μm.

It has been found that the dispersion liquid becomes unstable quickly as the particle growth rate exceeds 40%, corresponding to the particle size of from 0.3 to 0.4 mm of the pulverizing media (cf. Tables 1 and 2).

Though not described in FIG. 1, when the pigment was pulverized down to less than 0.1 μm, the pigment dispersoids coagulate so quickly on the scale of an hour that such the dispersion liquid can not be used in practice.

According to the invention, mass-productivity and photoconductive properties are improved by forming a charge generation layer by dip coating using a dispersion liquid, in which an organic pigment or dye, pulverized to an average particle size of from 0.1 to 0.3 μm, is dispersed as a charge generation agent with a resin binder.

For obtaining the effects of the invention, it is preferable to disperse 5 to 95 weight % of organic pigment or dye with respect to the solid components in the dispersion liquid with ball-shaped pulverizing media of 0.1 to 0.3 mm in diameter.

For obtaining the effects of the invention, it is also preferable to use, in dispersing process, the ball-shaped pulverizing media 0.25 to 5 times as heavy as the dispersion liquid.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of manufacturing a charge generation layer of an organic photoconductor for electrophotography, said method comprising:

dispersing and pulverizing, with ball-shaped pulverizing media, an organic pigment or an organic dye and a resin binder in a dispersing solvent to an average particle size of from about 0.1 to about 0.3 μm, to form a dispersion liquid;

said organic pigment's ratio or said organic dye's ratio to said dispersion liquid's solid components being from about 5 to about 95 weight %;

said ball-shaped pulverizing media being from about 0.1 to about 0.3 mm in diameter;

said ball-shaped pulverizing media's total weight used in said step of dispersing being from about 0.25 to about 5 times said dispersion liquid's total weight liquid; and forming said charge generation layer by coating a surface with said dispersion.

2. The method of claim 1, wherein said step of forming includes drying said dispersion liquid after said coating.

3. The method of claim 1, further comprising a step of removing said ball-shaped pulverizing media from said dispersion liquid prior to said step of forming.

* * * * *